US005570725A

United States Patent [19]

Musha et al.

[11] Patent Number: 5,570,725

[45] Date of Patent: Nov. 5, 1996

[54] WEAVING METHOD AND REED USED WITH 1/F FLUCTUATIONS

[75] Inventors: Toshimitsu Musha, 13-17, Minami-Tsukushino 2-chome, Machida-shi, Tokyo; Yuichi Yanai, Okazaki; Shoji Takagi, Okazaki; Yuki Niwa, Okazaki, all of Japan

[73] Assignees: Toshimitsu Musha; Nisshinbo Industries, Inc., both of Tokyo, Japan

[21] Appl. No.: 413,861

[22] Filed: Mar. 29, 1995

[30] Foreign Application Priority Data

Mar. 31, 1994 [JP] Japan ..... 6-085683

[51] Int. Cl.[6] ..... D03D 49/62

[52] U.S. Cl. ..... 139/192; 364/470.01

[58] Field of Search ..... 364/154, 152, 364/470; D5/47; 139/192, 29, 191, 189; 57/206

[56] References Cited

U.S. PATENT DOCUMENTS

| | | | |
|---|---|---|---|
| 1,988,977 | 1/1935 | Andrews | 139/192 |
| 2,048,001 | 7/1936 | Fish | 139/192 |
| 2,643,684 | 6/1953 | Taylor | 139/192 |
| 3,018,801 | 1/1962 | Coon et al. | 139/29 |
| 3,638,297 | 2/1972 | Ditscherlein | 139/192 X |
| 3,952,386 | 4/1976 | Joly et al. . | |
| 4,058,968 | 11/1977 | Benson . | |
| 4,059,950 | 11/1977 | Negishi et al. | 57/206 X |
| 4,495,244 | 1/1985 | Phillips | 57/206 X |
| 4,495,560 | 1/1985 | Sugimoto et al. | 364/154 |
| 5,243,267 | 9/1993 | Ogasawara . | |

FOREIGN PATENT DOCUMENTS

| | | | |
|---|---|---|---|
| 0260062 | 3/1988 | European Pat. Off. . | |
| 327950 | 4/1902 | France . | |
| 1490531 | 11/1967 | France . | |
| 549264 | 4/1932 | Germany . | |
| 1527342 | 12/1989 | U.S.S.R. | 139/192 |
| 2022871 | 12/1979 | United Kingdom . | |

OTHER PUBLICATIONS

"Biological Signals—Actual Measurement and Analysis—", 1989, Corona Publishing Co.

"Physics of the Living State", Ohmsha, 1994.

"Noise in Physical Systems and 1/f Fluctuations" World Scientific, May 29, 1995–June 3, 1995.

Journal of Japan, Soc. of Precision Machinery vol. 50, No. 6, 1985 'Bioinformation and 1/f Fluctuation' *the whole document* (No Translation).

London, Derwent Publications Ltd., AN 94–045881.

*Primary Examiner*—Andy Falik

*Attorney, Agent, or Firm*—Nikaido Marmelstein Murray & Oram LLP

[57] ABSTRACT

A weaving method and reed where the method is practiced with the reed having spacings between dents of 1/f fluctuations resulting in a woven fabric which has a warp density of 1/f fluctuations. The spacings are established by winding yarn having a 1/f fluctuation around the dent support bars with the dents positioned between the coils of wrapped yarn.

3 Claims, 5 Drawing Sheets

Fig. 2

WEAVING METHOD AND REED USED WITH 1/F FLUCTUATIONS

BACKGROUND OF THE INVENTION

This invention relates to a weaving woven fabric.

Conventional weaving processes use a reed with uniform spacing between dents to weave goods with uniform spacing between warp yarns. Uneven or irregular weaves are woven with randomly-spaced warp yarns by randomly removing warp yarns passing through the reed or using yarns having a different coarseness.

Conventional weaving machines produce woven fabric in which the warp yarns have uniform spacing or which vary at random. When comparing these to woven fabric which has a natural, irregular feel as a result of hand weaving using yarns spun by hand, this randomness produces an artificial texture with very little natural feel, and is not particularly comfortable for the wearer.

OBJECT AND SUMMARY OF THIS INVENTION

It is an object of this invention to make woven fabric available that provides a natural feeling of comfort to human beings.

Another object of this invention is to provide a weaving method which causes the density of the warp yarns in woven fabric to specifically have a correlation of a 1/f fluctuation.

Another object of this invention is to provide a reed which causes the density of the warp yarns in woven fabric made on a loom using the reed to specifically have a correlation, of a 1/f fluctuation.

This invention provides a method of manufacturing woven fabric on an industrial scale in which the spacing of the warp yarns does not vary randomly, but the irregularity rather has a correlation of a 1/f fluctuation, and thus the woven fabric will have a natural feeling of unevenness.

In this invention, "1/fluctuation" is defined as a power spectrum with a frequency component f, proportional to $1/f^k$, where k is approximately 1.

One aspect of the present invention is a weaving method for weaving woven fabric, wherein warp yarns pass through a reed in which the spacing between dents has a 1/f fluctuation. The warp yarns are separated into two sets to form a shed between the two sets. The weft yarns are passed through the shed, causing the warp yarns and weft yarns to cross over each other, thereby weaving woven fabric in which the density of the warp yarns has a 1/f fluctuation.

A second aspect of the present invention is a reed used in weaving, wherein the spacing between dents has a 1/f fluctuation.

A third aspect of the present invention is a reed used in weaving, wherein, the reed has a pair of bars holding a plural number of dents, a yarn having a 1/f fluctuation wound around the bars, and an arrangement of dents between the yarns in which the spacing between dents has a 1/f fluctuation.

This invention is effective as follows.

The spacing between warp yarns does not change randomly; rather, the change has a correlation, and because this correlation has a 1/f fluctuation, it imparts a special feeling of comfort and aesthetic beauty to the wearer.

Woven fabric with a hand-woven natural irregular feel can be manufactured at low cost on an industrial scale.

Dents spaced with a 1/f fluctuation are easily formed using yarn having a 1/f fluctuation.

Incorporating a melody or tone having a 1/f fluctuation into woven fabric can evoke a feeling of comfort in the wearer.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENT

Figure 1:
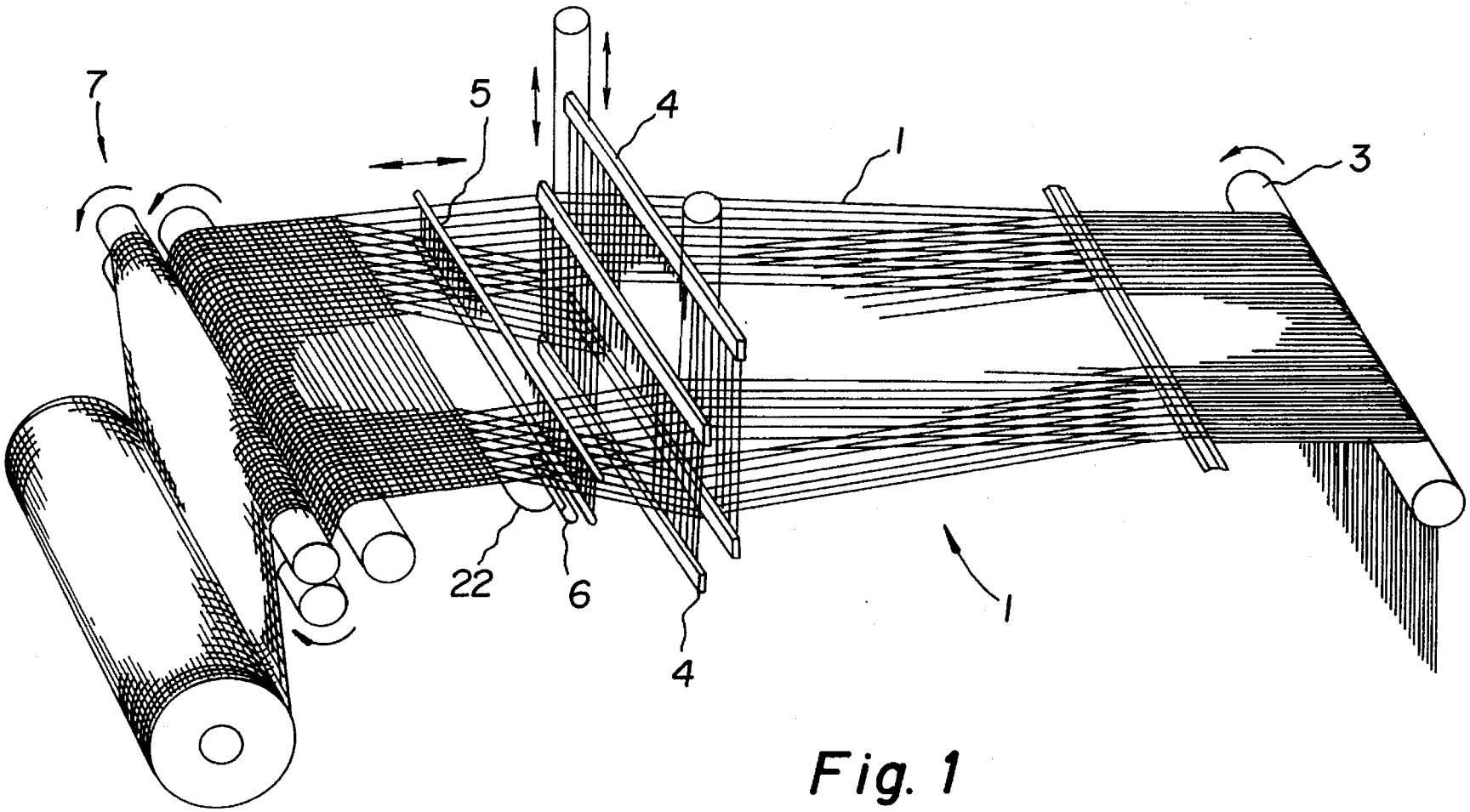
FIG. 1 shows an overview diagram of the principal components of a weaving machine or loom according to the present invention.

Weaving machine 1 weaves spun yarn into woven fabric 2 through the primary movements of opening the shed, inserting the weft yarn, and beating the weft, and the secondary movements of letting off warp yarns 21 and taking up woven fabric 2. It is constructed, for example, as shown in FIG. 1. The action of opening the shed divides all the warp yarns into two sets, forming an opening through which weft yarn 22 passes, and causing warp yarns 21 and weft yarn 22 to intersect. For this purpose, warp yarns 21 are threaded through two sets of heddles 4 in a prescribed order, and the up and down action of these heddles 4 separates the warp yarns 21 vertically. The weft insertion movement, for example, involves passing shuttle 6, in which a weft yarn 22 is wound around a wooden tube, through the inside of the shed formed by the warp yarns, thereby shooting the weft yarn across the warp yarns. In addition to a shuttle, other methods of weft insertion may be used, including air, water, rapiers, grippers, etc. The weft beating motion causes warp yarn 21 and weft yarn 22 to intersect by using reed 5 to apply pressure to weft yarn 22 after the weft yarn 22 passes through the inside of the shed formed by the warp, and forces the yarns into a prescribed position. Let-off device 3 for warp yarns 21 gradually feeds the warp yarn 21 and take-up device 7 rolls up the woven fabric 2. The take-up speed for the woven fabric 2 can be set at a constant rate or can also be controlled so that the speed varies.

Figure 2:
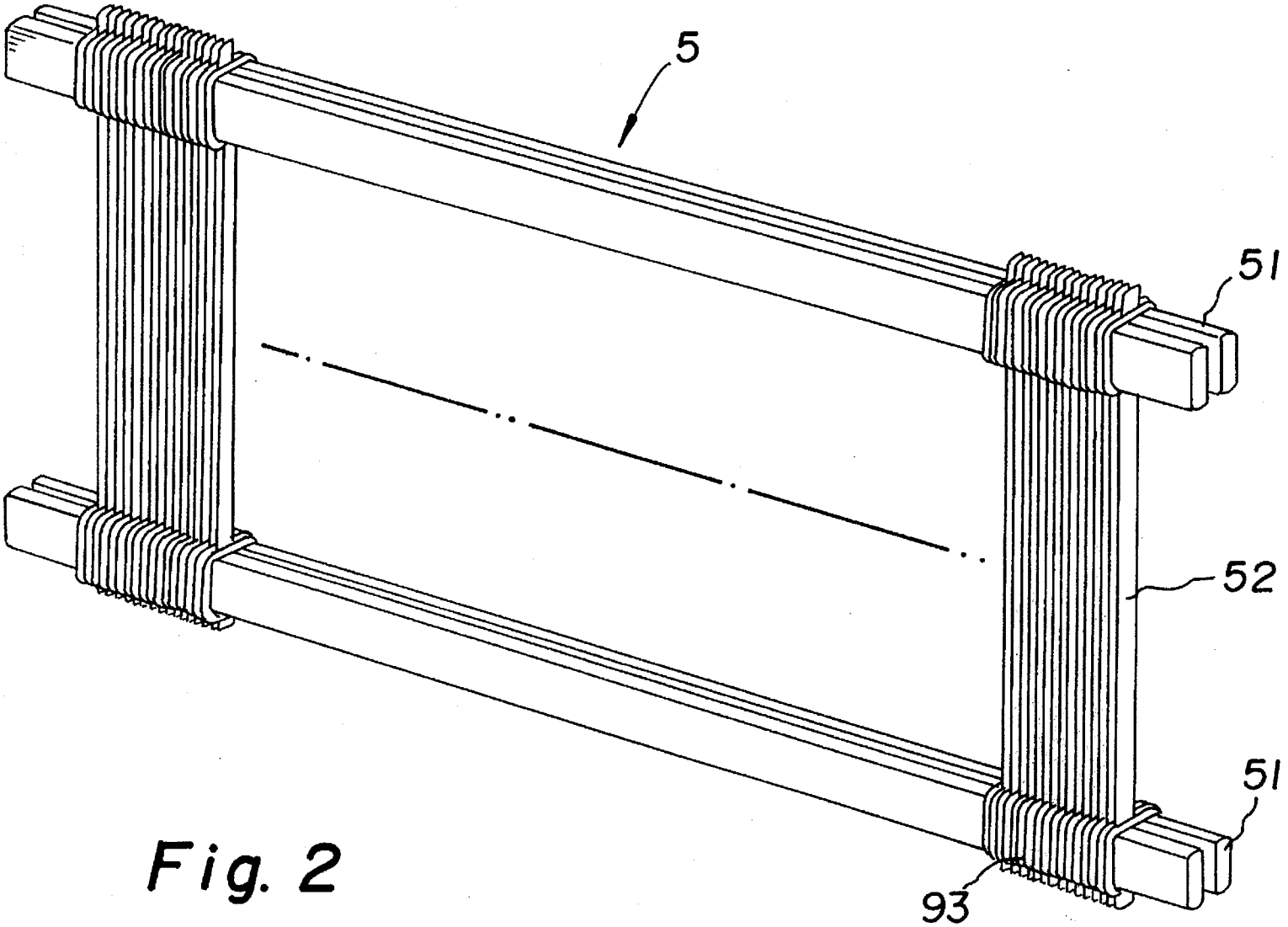
FIG. 2 is a diagram illustrating a reed.

Reed 5 determines the spacing between the warp yarns 21, and is constructed so that dents 52 (reed wires) are arranged between two bars 51, for example, as shown in FIG. 2. Bars 51 of reed 5 have slots into which dents 52 are inserted. The bars 51 can have a diameter of 1 cm. In addition, dents 52 are, for example, fabricated of steel, and have a width of 2.8 mm and a thickness of 0.2 mm. A spacing having a 1/f fluctuation imposed between the dents will cause the density of warp yarns 21 to have a 1/f fluctuation. To set the spacing between dents, for example, a yarn 93 whose diameter varies with a 1/f fluctuation is closely wound onto bars 51 of reed 5, and by interposing dents 52 between the coils of yarn 93, a 1/f fluctuation will be imparted to the spacing between dents. The gaps between dents 52 can be made parallel by winding two such yarns 93, each having an identical 1/f fluctuation, onto the two bars 51 in an identical manner. In addition, if reed 5 is fabricated by winding yarn 93 having a 1/f fluctuation only onto one bar 51, the dents 52 can also be arranged in parallel.

The present inventor was the first in the world to discover that a 1/f fluctuation would impart a feeling of particular comfort to human beings. The results were published in a paper entitled "Bioinformation and 1/f Fluctuation," *Applied Physics,* 1985, pp. 429–435, and in another paper titled "Biocontrol and *1/f Fluctuation,"* Journal of Japan Soc. of Precision Machinery, 1984, Vol. 50, No. 6. The abstract of these papers read, "A 1/f fluctuation provides a comfortable feeling to humans, the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore, a 1/f fluctuation is a fluctuation of the right proportion between these two extremes." In addition, an excerpt from "The World of Fluctuations" by Kodansha Publisher, 1980, reads "For example, the rhythms exhibited by the human body such as heart beats, handclapping to music, impulse-release period of neurons, and alpha rhythms observed in the brain, are all basically 1/f fluctuations, and it has been shown experimentally that if a body is stimulated by a fluctuation like these biorhythmic 1/f fluctuations, it would feel comfortable." Fluctuations (variations) exist in various forms throughout nature, but the murmur of a brook, a breeze of wind, and other phenomena that impart a comfortable feeling to humans have a 1/f fluctuation, while typhoons and other strong winds that evoke a sense of uneasiness do not have this 1/f fluctuation.

The 1/f fluctuation signal is determined from $Y_1, Y_2, Y_3, \ldots$ generated by multiplying n coefficients, $a_1, a_2, a_3, \ldots, a_n$, in a sequence of random numbers, $X_1, X_2\ X_3 \ldots$ Generally, $Y_j$ can be expressed by Equation 1. Here, the sequence of numerical values forming $Y_1, Y_2, Y_3, \ldots$ has a 1/f spectrum. (For further details, refer to *Seitai shingô* [*Biological Signaling*], Chapter 10, *"Biological Rhythms and Fluctuations,"* published by Corona Publishers, Ltd.)

$$y_j = x_j + \left(\frac{1}{2}\right) X_{j-1} + \left(\frac{1*3}{2^2*2!}\right) X_{j-2} + \left(\frac{1*3*5}{2^3*3!}\right) X_{j-3} + \ldots \left(\frac{1*3*5*\ldots*(2n-1)}{2^{n-1}*(n-1)!}\right) X_{j-n+1} \quad \text{(Equation 1)}$$

Figure 3:
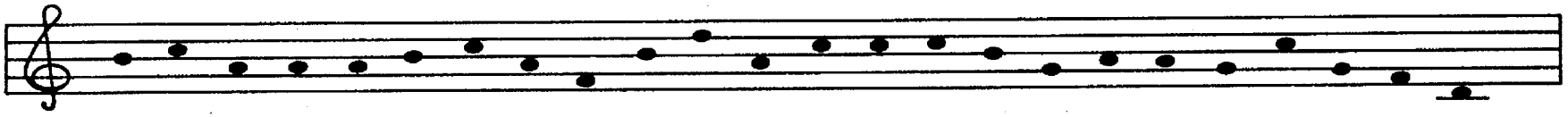
FIG. 3 is a diagram illustrating a portion of a melody with a 1/f fluctuation.

The 1/f-fluctuation signal is obtained in two steps. In step 1, a computer, for example, generates a sequence of random numbers, x. In step 2, this sequence of random numbers is stored in a storage device, where a certain number, n, of coefficients, a, are successively multiplied on the random numbers, and then, by a linear transformation, a sequence of numerical values, y, is obtained. This numerical sequence, y, has a 1/f spectrum, and can be used as a 1/f fluctuation signal, but here, a melody having a 1/f fluctuation is generated from this sequence of numerical Values, y, having a 1/f sequence. First, the scale and the range (lowest frequency fL and highest frequency fU) are determined. A 1/f sequence, y, is derived, and a linear transformation is performed so that the upper and lower limits become the lowest frequency fL and highest frequency fU, respectively. The values of the sequence, y, so derived are regarded as acoustic frequencies, and are substituted for the frequencies of the notes they most closely approximate on the scale. In other words, they are arranged, for example, as quarter notes, between or on the lines of a staff on music paper. FIG. 3 shows a portion of a melody derived using this method.

Figure 4:
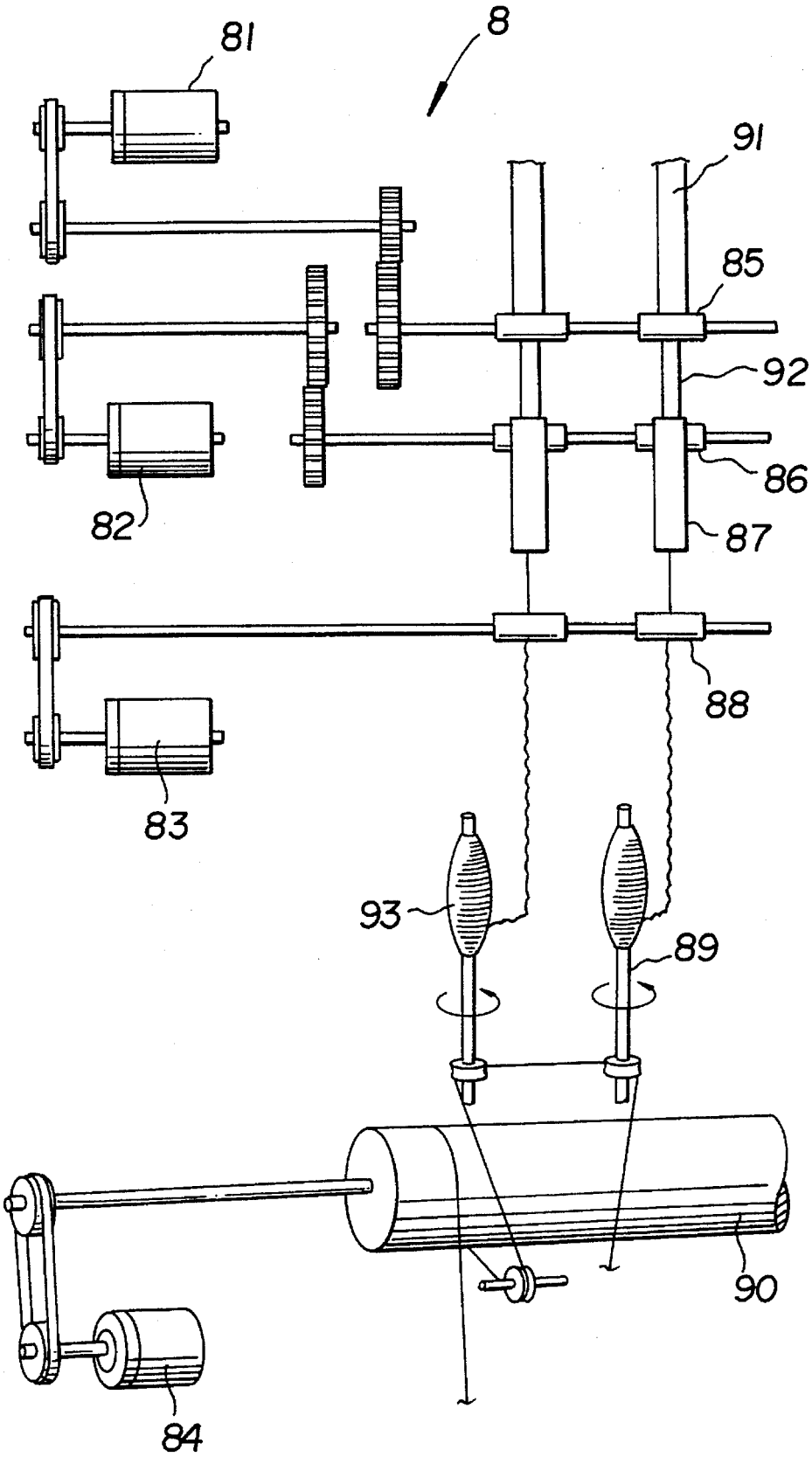
FIG. 4 shows an overview diagram of the principal components of a spinning frame.

Yarn 93 wound on bars 51 of reed 5 and having a 1/f fluctuation is fabricated using spinning frame 8 shown in FIG. 4. For example, rovings 91 are taken up by back roller 85, drafted between apron rollers 86 and back roller 85, and fed as fiber bundle 92 from apron roller 86. As fiber bundle 92 is taken up by front roller 88, a draft having a 1/f fluctuation is applied between apron roller 86 and front roller 88 by controlling the rotational speed of front motor 83 to incorporate the changes, for example as in the melody shown in FIG. 3 which has a 1/f fluctuation, thereby imparting a 1/f fluctuation to the diameter of yarn 93. Spindle 89 then winds fiber bundle 92 and applies a twist. At this point, the motor control is set so that the pitch and duration of the notes of the melody correspond, respectively, to the rotational speed of front roller 88 and the running time at that speed. For example, the duration of one note in the melody was set to be equivalent to 1 meter of yarn, the "la" note at 440 Hz was set to be equivalent to a thickness of yarn count 30, and the difference between each adjacent note on the "do, re, mi, fa, so, la, ti, do" scale was set to be equivalent to a yarn count of 5; under these conditions, the yarn becomes finer with higher frequencies.

Figure 5:
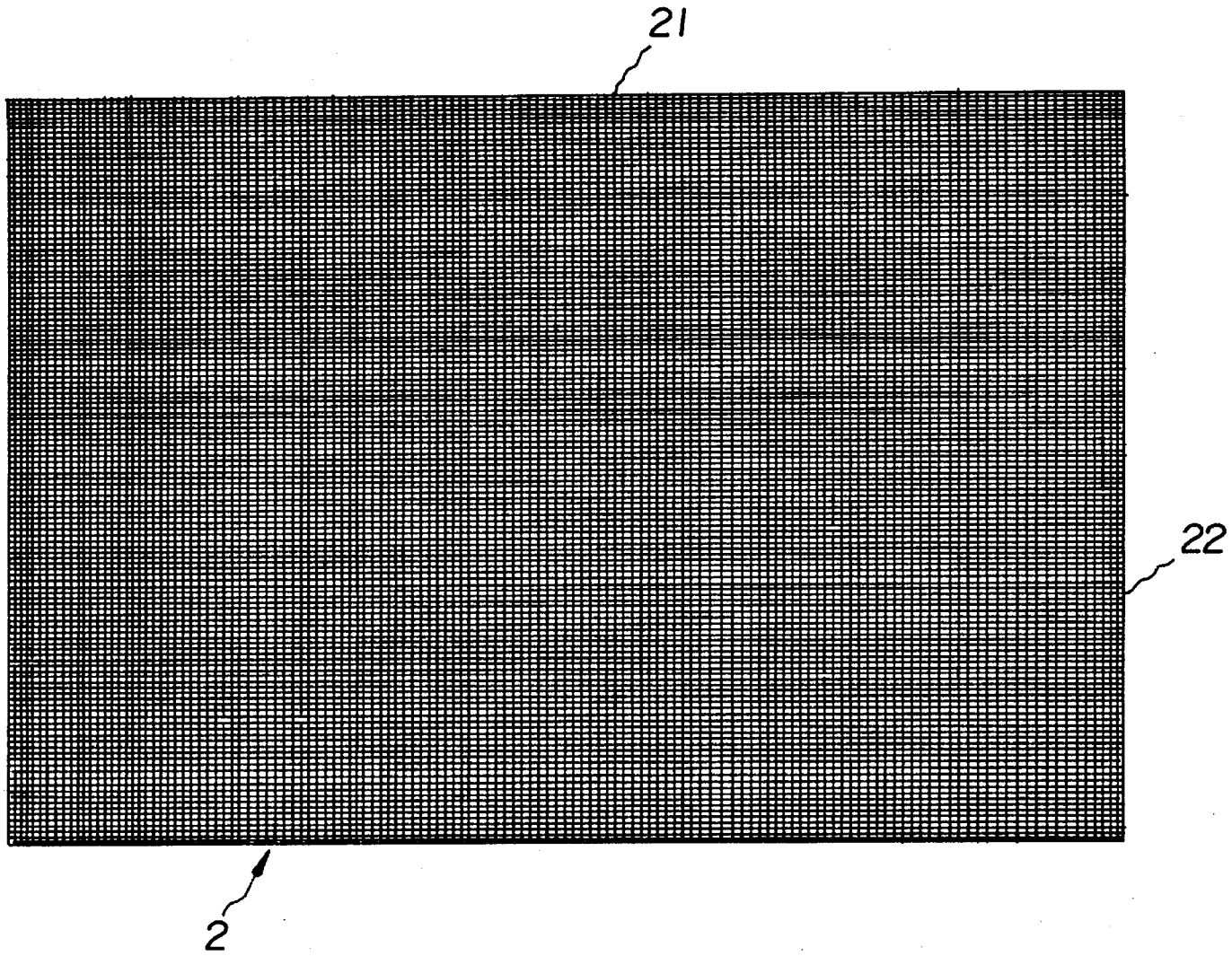
FIG. 5 is an enlarged diagram of woven fabric in which the density of the warp yarn has a 1/f fluctuation.

To create woven fabric in which the density of warp yarns 21 has a 1/f fluctuation, a reed 5 is created in which a yarn 93 derived using the melody in FIG. 3 is wound on each of a pair of bars 51 of reed 5. If the number of the dents of this reed 5 averages 72 dents/2 inches (two warp yarns will pass between each dent) and woven fabric 2 is woven using 30-count cotton yarn for the warp and weft yarns, the warp yarn density of woven fabric 2 will turn out to average 77 threads/inch and the weft density will average 70 threads/inch in the raw cloth. This example is shown in the enlarged diagram in FIG. 5. The density of the warp yarns 21 in woven fabric 2 has a 1/f fluctuation. Note that, in FIG. 5, warp yarns 21 lie along a line perpendicular to the side indicated by the leader line (line parallel to the direction extending from the leader line of warp yarn 21) and that weft yarns 22 are perpendicular to warp yarns 21 and lie along a line perpendicular to the side indicated by the leader line of weft yarn 22 (line parallel to the direction extending from leader line 22).

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A weaving method for weaving woven fabric comprising providing a reed in which the spacings between dents have a 1/f fluctuation, passing warp yarns through said reed, separating said warp yarns into two sets to form a shed between said two sets, passing weft yarns through said shed, and beating said weft yarns with said reed causing said warp yarns and weft yarns to intersect, thereby weaving woven fabric in which the density of the warp yarns has a 1/fluctuation.

2. A reed used in weaving, comprising dents wherein, the spacings between dents have a 1/f fluctuation.

3. A reed used in weaving, wherein, said reed has a pair of bars holding a plural number of dents, a yarn having a 1/f fluctuation wound around said bars between adjacent dents, and an arrangement of said dents between said yarns in which the spacing between dents have a 1/f fluctuation.

* * * * *